United States Patent [19]

Arnold

[11] Patent Number: 4,623,881

[45] Date of Patent: Nov. 18, 1986

[54] METHOD AND APPARATUS FOR INCREASING THE NUMBER OF CHARACTERS PER LINE IN A DIGITALLY GENERATED DISPLAY ON A LIMITED BANDWIDTH RASTER SCANNED DEVICE

[76] Inventor: Mark G. Arnold, 1400 Grand Ave., Laramie, Wyo. 82070

[21] Appl. No.: 566,722

[22] Filed: Dec. 29, 1983

[51] Int. Cl.[4] ..... G09G 1/14

[52] U.S. Cl. ..... 340/750; 340/747

[58] Field of Search ..... 340/750, 728, 744, 747; 358/12, 133, 136

[56] References Cited

U.S. PATENT DOCUMENTS

| | | | |
|---|---|---|---|
| 4,250,502 | 2/1981 | Klauck et al. | 340/728 |
| 4,321,599 | 3/1982 | Yoshiba | 340/750 X |
| 4,447,809 | 5/1984 | Kodama et al. | 340/750 X |
| 4,476,464 | 10/1984 | Hobbs | 340/750 X |
| 4,516,118 | 5/1985 | Wahlquist | 358/12 X |

*Primary Examiner*—Gerald L. Brigance

*Assistant Examiner*—Vincent P. Koalick

[57] ABSTRACT

A method and apparatus are provided for increasing the number of characters or symbols that can be displayed on a line when the video signal that produces the display is restricted to a limited bandwidth, such as in the case of RF modulating the video signal to produce the display on an unmodified television set. The bandwidth of the video signal is reduced by displaying different portions of the display during one field time and the remaining portion of the display during the next field time. The persistence of the television screen creates the illusion of a complete display. Each luminescent region of each line will be displayed during one field time and blanked during the next field time. In the preferred embodiment, adjacent luminescent regions of a scan line (e.g., separated only by a black region) will be displayed in opposite fields. In an alternative embodiment, adjacent character regions will be displayed in opposite fields. The invention is compatible with standard and high definition television receivers.

19 Claims, 5 Drawing Figures

METHOD AND APPARATUS FOR INCREASING THE NUMBER OF CHARACTERS PER LINE IN A DIGITALLY GENERATED DISPLAY ON A LIMITED BANDWIDTH RASTER SCANNED DEVICE

FIELD OF THE INVENTION

This invention relates to the generation of textual messages from a digital source, and their transmission to a standard television receiver, and more particularly, to reducing the bandwidth of the signal sent to the television receiver so that an increased number of characters or symbols can be legibly displayed.

BACKGROUND AND SUMMARY OF THE INVENTION

The increasing demand for information processing has created the need for many products and services which process and display information. Such products and services typically generate an RF modulated signal suitable for use with an unmodified television set. This has the advantage of reducing the cost of the product or service, since an expensive monitor is not needed. However, the bandwidth limitations of RF modulation for standard TV sets limits the number of characters or alphamosaic symbols that can be legibly displayed on a line to approximately 40. The limitation is especially noticeable on color television sets.

The prior art, typified by U.S. Pat. No. 4,212,008 and U.S. Pat. No. 4,053,878, shows some improvement in the quality of the display when number of characters per line exceeds the limitations imposed by the bandwidth of the display device; however, the prior art is limited and inferior to the present invention in that the prior art cannot greatly increase the number of characters that can be displayed per line. This is especially true for letters, such as lower case "m", that have very high frequency components. What limited reduction of the high frequency component that occurs in some of the prior art requires an expensive double sized, non standard, character generator Read Only Memory.

Techniques for improving the appearance of analog video signals generated by slow scan TV devices are disclosed in the prior art, as typified by U.S. Pat. No. 4,053,931; but such techiques are not applicable for displaying digitally generated alphamosaic symbols, in that such prior art techniques do not decrease the bandwidth of a digitally generated signal, but rather increase it by including a high frequency memory clocking signal in the video output signal. Such memory clocking signals are not normally included as part of a digitally generated character display, and are not introduced into the video signal by the present invention.

Techniques for generating video and keying signals that superimpose self contrasting characters in another video signal are disclosed in the prior art, as typified by U.S. Pat. No. 3,781,849; however, the prior art does not disclose a bandwidth reduction technique suitable for increasing the number of characters per line that can be displayed.

Accordingly, it is an object of the present invention to increase the number of characters or symbols that can be displayed on a line with an unmodified television set.

Another object of the present invention is to reduce the bandwidth of a digitally generated video signal that represents textual information before the video signal is RF modulated, without using any signal other than the video signal.

A further object of the present invention is to decrease the bandwidth of a video signal produced by a standard character generator ROM.

Still another object of the present invention is to allow a 2-level video luminance signal to be transformed to a reduced bandwitdh 2-level video luminance signal.

Still a further object of the present invention is to allow legible display of characters or symbols that have a high frequency component, such as lower case "m".

Still another object of the present invention is to allow bandwidth reduction of the signal from a video generating digital device, which has a memory and a register that indicates the region of the memory being displayed.

Still a further object of the present invention is to allow bandwidth reduction with a novel character generator read only memory.

PREFERRED EMBODIMENT

The typical broadcast signal received by a TV set has frames with 525 lines, of which 262½ are transmitted in the odd field and 262½ are transmitted in the even field. The interfacing of the odd and even fields happens fast enough that the viewer of the TV set does not notice it. The effect of interlacing in a standard broadcast TV signal is to increase the vertical resolution of the perceived display. The horizontal resolution of the display in a standard TV signal is limited by the bandwidth restriction imposed by the RF signal used to transmit the information to the TV set.

In the prior art, when digitally generated textual messages are sent to a TV set, the video signal typically is made up of identical odd and even fields (assuming the displayed message remains constant during this time). Such fields often do not have exactly 262½ lines. The video signal is then RF modulated and sent to the TV set. The modulation limits the bandwidth of the video to approximately 3.5 MHz. This bandwidth restriction in the prior art limits the number of characters that can be displayed per line on a standard TV set.

The present invention increases the number of characters per line that can be legibly displayed on a standard TV by displaying different portions of the display during odd and even field times. Unlike standard broadcast TV, the odd field lines do not have to be between even field lines since in the present invention, the goal is not to increase vertical resolution (as is the goal in standard broadcast TV).

The preferred embodiment classifies the bits to be displayed on the screen into two groups: those that are displayed in the odd field, and those that will be displayed in the even field. In the preferred embodiment, contiguous groups of bits that are all 1s are displayed in the same field. The next contiguous group of bits that are all 1s are displayed in the opposite field. A contiguous group of 1s will have at least one 0 preceding the group and at least one 0 following the group. For example, consider the bit patterns representing a portion of the screen where the letters "HI" are displayed:

```
01000100111110
01000100001000
01000100001000
01111100001000
01000100001000
01000100001000
01000100111110
```

In the preferred embodiment, the odd field might be:

```
01000000111110
01000000010000
01000000001000
01111100000000
01000000001000
01000000001000
01000000111110
```

The corresponding even field would be:

```
00000100000000
00000100000000
00000100000000
00000000001000
00000100000000
00000100000000
00000100000000
```

The same effect would be achieved if the roles of the odd fields and even fields were reversed.

Figure 4A:
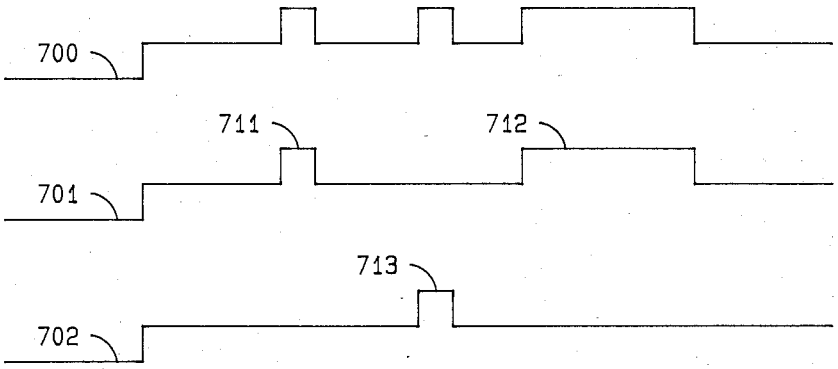
FIG. 4A is a timing diagram showing video signals generated by the preferred embodiment during the display of the first raster line of the image shown in FIG. 4B.
Figure 4B:
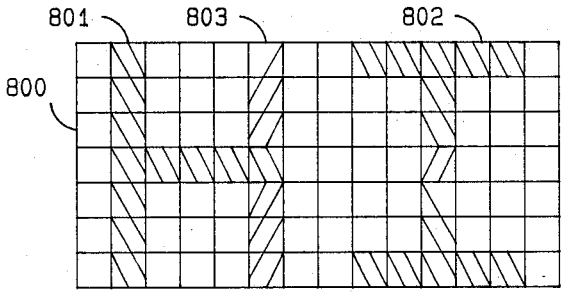
FIG. 4B shows an image produced by the video signals generated by the preferred embodiment.

Referring to FIG. 4A, video signal 700 is typical of what would be generated by prior art methods for the first line when displaying the letters "HI". Video signal 701 is the output of the preferred embodiment for that line during a first (e.g., odd) field. Contiguous pixel groups 711 and 712 are included in video signal 701. Video signal 702 is the output of the preferred embodiment during the next (e.g., even) field. Contiguous pixel group 713 is included in video signal 702. Referring to FIG. 4A and FIG. 4B, after both fields have been displayed, the resulting image 800 has white regions 801 and 802 produced by contiguous pixel groups 711 and 712, respectively. Image 800 also has white region 803 produced by contiguous group 713.

Figure 1:
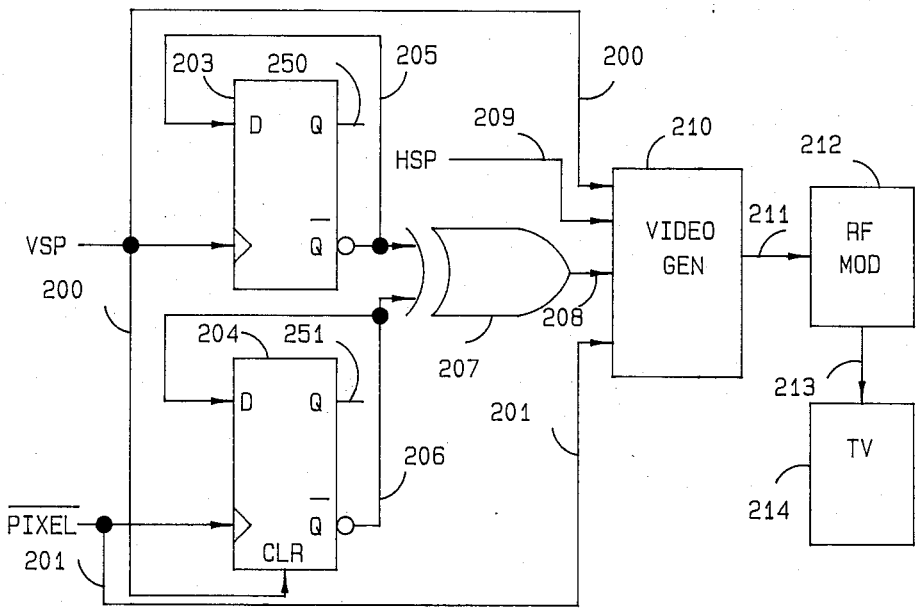
FIG. 1 is a circuit diagram of the preferred embodiment of the present invention as it would be implemented as part of a larger digital system.

Referring to FIG. 1, the preferred embodiment uses the vertical sync pulse (VSP) on line 200 to clock a flip flop 203. From flip flop 203 comes the $\overline{Q}$ output on line 205 which is connected to the D input of flip flop 203, thereby making flip flop 203 a divide by two counter (i.e., modulo 2 counter). The output 205 indicates whether the current field is an odd field or an even field (i.e., field parity). The field parity output 205 is also connected to one input of an exclusive or 207.

The output 201 of the digital device generating the bit pattern to be displayed (e.g., shift register) is connected to the clock input of the edge driven D type flip flop 204. This output 201 has previously been negated, so that the flip flop changes state when the data to be displayed changes from 1 to a 0. The $\overline{Q}$ output 206 of the flip flop 204 is connected to the D input of flip flop 204, thereby making flip flop 204 a divide by two counter. The output 206 indicates whether the current bit pattern should be displayed in the odd or even field. The output 206 is connected to the other input of exclusive or 207. The output of exclusive or 207 on line 208 is used to blank the video signal when the data on line 201 is not to be displayed. The video generation circuit 210 used in the present invention is similar to those used in the prior art. It has a blanking input 208, a VSP input 200, a data input 201, and a HSP input 209 (HSP is not provided by the present invention). The composite video output 211 is input to a RF modulator 212 which is connected via cable 213 to TV set 214.

Lines 200, 201, and 209 come directly from the digital device generating the video.

Other state machines could be implemented by those skilled in the art to separate the bits into odd and even fields according to the preferred embodiment. Either one or both of the inputs to exclusive or 207 could have been connected to the respective Q outputs (250 and 251) of the flip flops 203 and 204. Signal 200 could be complemented before being provided as the input to flip flop 203. Signal 201 could be complemented before being provided as input to flip flop 204. There are several possibilities for the clear (or preset) inputs of flip flop 204: these inputs could be left unused, or one or the other could be tied to the digital sync 402 (from FIG. 3), or to the horizontal sync 209, or to a character timing signal that is active at the end of each character time. The reason for choosing one of these instead of leaving the set and clear inputs of flip flop 204 unused is to prevent flicker when the characters in the display are changing. In some applications it may be acceptable to leave the preset and clear inputs of flip flop 204 unused.

There is a way to implement a variation of the preferred embodiment equivalent to tieing the clear (or preset) input of flip flop 204 to a character timing signal that is active at the end of each character time. This alternative way to implement the preferred embodiment eliminates the flip flop 204 and exclusive or 207, and achieves the same effect by replacing the character generator ROM in the digital device that generates the video with a special character generator ROM. In addition to the normal line and character code signal inputs, this special character generator ROM has one additional input signal: the field parity. This allows the character generator ROM to produce different bit patterns for the same character during odd and even fields. For example, in a standard character generator, the contents corresponding to the letter "m" might be:

```
00000
01010
10101
10101
10101
10101
00000
```

In the special character generator described above, the contents used during alternative field times would be:

```
00000
01000
```

-continued

| |
|---|
| 10001 |
| 10001 |
| 10001 |
| 10001 |
| 00000 |

and the contents used during the remaining field times would be:

| |
|---|
| 00000 |
| 00010 |
| 00100 |
| 00100 |
| 00100 |
| 00100 |
| 00000 |

Figure 3:
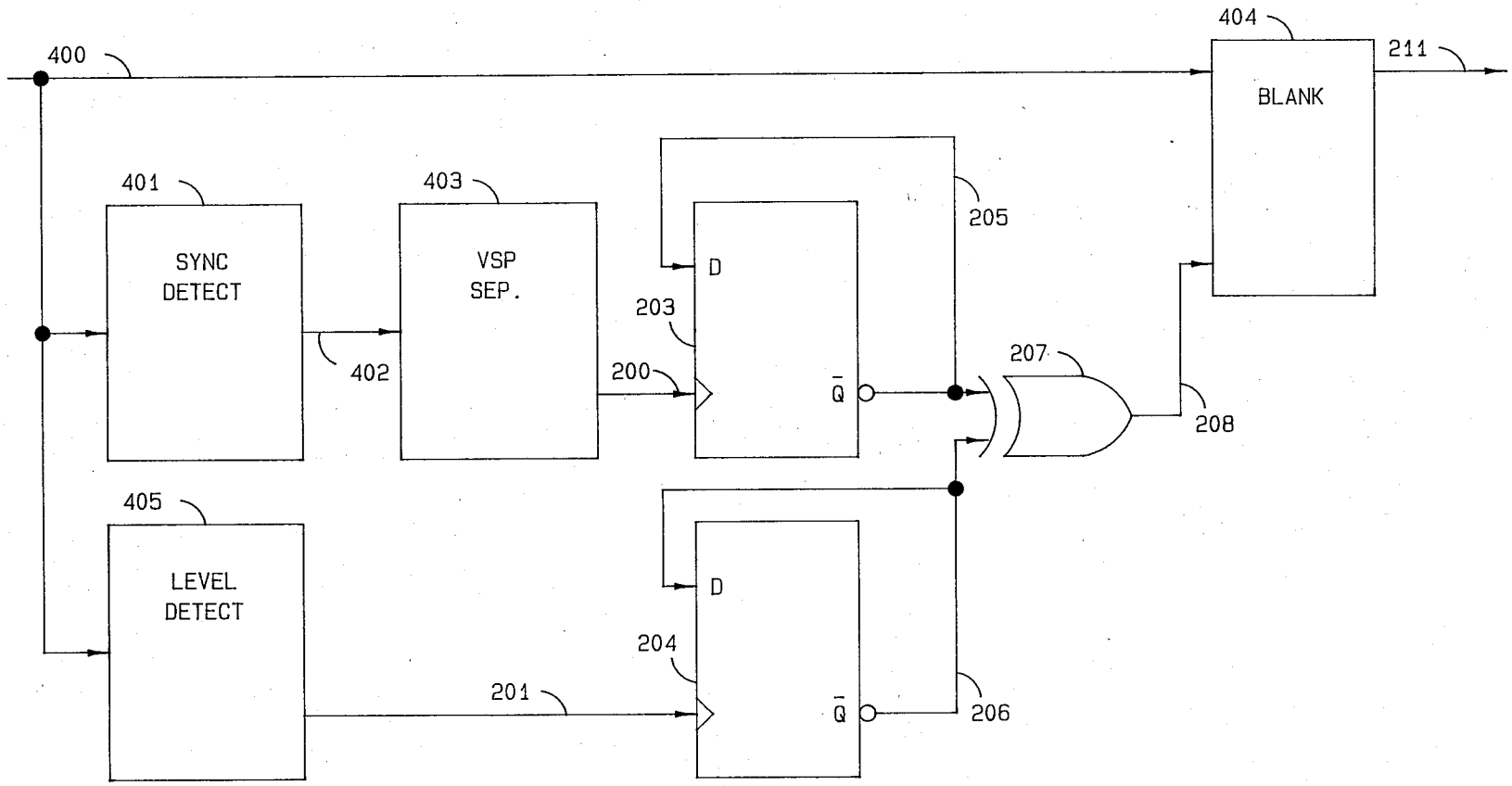
FIG. 3 is a circuit diagram of the preferred embodiment implemented as an independent unit.

Referring to FIG. 3, the preferred embodiment can be implemented as an independent unit whose only input is a composite video signal 400, which is supplied to a sync level detector 401. The sync level detector 401 will generate a digital sync signal 402 that indicates both horizontal and vertical sync periods. The sync signal 402 is connected to a vertical sync separator 403, which produces the output 200 only when the duration of the sync signal 402 indicates that it is a vertical sync pulse. The output 200 is the clock input to flip flop 203. The composite video signal 400 is also supplied to level detector 405 which produces output 201. The level detector 405 compares the composite video signal 400 with two levels of luminance, and provides as its output a digital signal 201 that represents these two levels of luminance. The output 201 is connected to the clock input of flip flop 204. The outputs 205 and 206 from the flip flops 203 and 204, respectively are provided as inputs to the exclusive or 207. The output 208 of the exclusive or 207 controls a blanking circuit 404. The blanking circuit 404 takes as its input composite video signal 400. The output 211 of the blanking circuit 404 will be signal 400 when the digital signal 208 is inactive. The output 211 of the blanking circuit 404 will be a clipped version of signal 404 when the digital signal 208 is active. Sync and chrominance information need not be disturbed by blanking circuit 404. Leaving the chrominance information unmodified assumes that line 400 provide valid chrominance information. Those skilled in the art will realize short duration white pixels (less than 140 ns) will be interpreted as colored pixels. Therefore, if monochrome display on a color television set is desired, a filter could be included in blanking circuit 404 that removes the 3.579 MHz component of the video signal. Also, a 3.579 MHz oscillator could be included to provide a color burst reference in signal 211.

SECOND EMBODIMENT

The second embodiment provides for different odd and even fields on a character by character basis. For example, in the prior art, when displaying "ABCDE" the odd field for this text would be:

ABCDE

The even field would be the same. In the second embodiment the even field might be:

A C E

And so the corresponding odd field would be:

B D

The same effect could be achieved if the roles of the odd and even fields were reversed.

Figure 2:
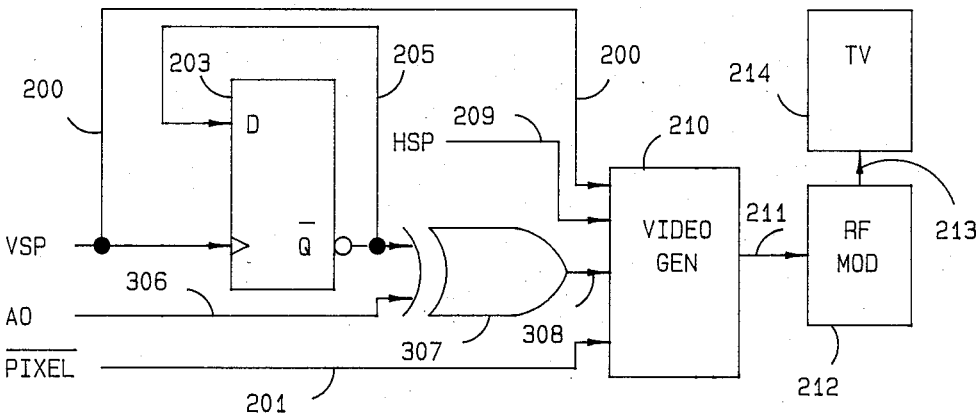
FIG. 2 is a circuit diagram showing the second embodiment.

Referring to FIG. 2, the second embodiment uses VSP 200 to clock flip flop 203. The output 205 connects to the D input of flip flop 203, making it a divide by two counter. The output 205 is the field parity. The field parity 205 is connected to one input of an exclusive or 307. The other input of the exclusive or 307 is the low order address bit (A0) on line 306. This low order address bit comes from the digital device generating the textual information. It comes from the address bus used by the digital device for fetching characters from its own memory.

The video generating circuit 210 takes lines 200, 209, 308, and 201. Circuit 210 provides composite video on line 211. The RF modulator 212 takes the signal 211 and transmits it via cable 213 to TV set 214.

The Q output of flip flop 203 could have been connected to exclusive or 307 instead of the $\overline{Q}$ output. A0 could have been inverted before connecting it to the exclusive or 307. Other state machines could be implemented that display characters from odd addresses in odd fields and characters from even addresses in even fields. Also, similar state machines could be implemented that achieve the same effect by displaying characters from odd addresses in even fields and characters from even addresses in odd fields. Separate memories could be kept for odd and even fields, with a multiplexer that selects which memory is to be displayed based upon the field parity.

Another possibility for both the preferred and second embodiments, would be to have a pointer register that alternatively points to separate regions of the same memory. During odd field times this pointer register would point to a first region of memory, and during even field times, this register would point to a second region of memory.

If these two regions of memory contain characters, the second embodiment can be implemented by storing blanks in every other location of the first region, and in the opposite locations in the second region.

If these regions of memory contain pixels, it would be possible to implement either the preferred or second embodiments. To implement the preferred embodiment, bit patterns such as those described for the odd field in the preferred embodiment would be stored in the first region, and the appropriate even field would be stored in second region. A process for separating a display, represented as a matrix of pixel bits, into odd and even fields, stored in a first and second region of memory, respectively, is described below:

```
TYPE PIXEL = 0 . . . 1;
MATRIX = ARRAY[1 . . . MR,1 . . . MC] OF PIXEL;
(*MR is CONST number of rows, MC is CONST number of cols*)
VAR ROW, COL: INTEGER;
IMAGE:      MATRIX; (*Display image to be generated*)
FIRST:      MATRIX; (*First region of memory*)
SECOND:     MATRIX; (*Second region of memory*)
LAST:       PIXEL; (*Previous pixel on the line*)
CURRENT:    PIXEL; (*Pixel adjacent to LAST*)
```

-continued

```
FLAG:          BOOLEAN; (*Used to separate pixels*)
BEGIN
GENERATEIMAGE (IMAGE); (*Generate desired image*)
FOR ROW := 1 TO MR DO
BEGIN
LAST := IMAGE [ROW,1]; (Either or both of these*)
FLAG := TRUE; (*Could be before FOR ROW*)
FOR COL := 1 TO MC DO
BEGIN
CURRENT := IMAGE [ROW, COL];
IF FLAG THEN
BEGIN
FIRST [ROW, COL] := CURRENT;
SECOND [ROW COL] := 0;
END
ELSE
BEGIN
FIRST [ROW, COL] := 0;
SECOND [ROW, COL] := CURRENT;
END; (*if*)
IF (LAST=1) AND (CURRENT=0) THEN FLAG := NOT FLAG; LAST :=
CURRENT;
END; (*for*)
END; (*for*)
END:
```

This process would be embodied as part of the firmware of a system which utilizes the present invention. Those skilled in the art will realize there are many other ways to implement for the separation of pixels into the two regions of memory. For speed consideration, a machine language implementation (or a hardware implementation) may be desirable.

In the above discussion, a bit value of 1 has been considered to be an active pixel (one which causes a dot to be displayed on the screen) and a bit value of 0 has been considered to be an inactive pixel. Those skilled in the art can implement the present invention when 0 is an active pixel and 1 is an inactive pixel.

What is claimed is:

1. A process for displaying an increased number of symbols per horizontal line on a display screen capable of displaying an image composed of a first field and a second field, whereby said first field is composed of a first plurality of raster lines created by patterns of active and inactive pixels, and said second field is composed of a second plurality of raster lines created by patterns of active and inactive pixels, comprising the steps of:

selecting a horizontal line of said display screen;

first classifying as being of a first kind every other single or plurality of contiguous active pixels of said image that are to be displayed on said horizontal line;

second classifying as being of a second kind those single or pluralities of contiguous active pixels of said image that are to be displayed on said horizontal line, and that are not classified by said first classifying step;

repeating, for each horizontal line of said display screen, said steps of selecting, first classifying and second classifying; and producing said image on said display screen including the steps of:

sequentially selecting in said first field a raster line, displaying in said first field active pixels of said raster line classified as being of said first kind, blanking in said first field segments of said raster line corresponding to pixels not classified as being of said first kind, repeating, for each raster line in said first field, said steps of sequentially selecting in said first field, displaying in said first field, and blanking in said first field, sequentially selecting in said second field a raster line, displaying in said second field active pixels of said raster line classified as being of said second kind, blanking in said second field segments of said raster line corresponding to pixels not classified as being of said second kind, repeating, for each raster line in said second field, said steps of sequentially selecting in said second field, displaying in said second field, and blanking in said second field.

2. The process of claim 1, wherein said step of first classifying further comprises the steps of:

providing one or more memories for storing bits representing active and inactive pixels, having a first region for storing the representation of said first field, and having a second region for storing the representation of said second field;

storing in said first region the representation of those portions of said horizontal line that are classified as being of said first kind at an address offset from the starting position of said first region by an amount proportional to the position of said horizontal line in said image; and storing the representation of inactive pixels everywhere else in said first region that corresponds to said horizontal line.

3. The process of claim 2, wherein said step of second classifying further comprises the steps of:

storing in said second region the representation of those portions of said horizontal line that are classified as being of said second kind at an address offset from the starting position of said second region by an amount proportional to the position of said horizontal line in said image; and storing the representation of inactive pixels everywhere else in said second region that corresponds to said horizontal line.

4. The process of claim 3, wherein said step of producing further comprises the steps of:

loading a register with an address indicative of said starting position of said first region to initiate display of said first field;

generating said first field on said display screen using information in said first region pointed to by said address loaded in said register;

loading said register with an address indicative of said starting position of said second region to initiate display of said second field; and generating said second field on said display screen using information in said second region pointed to by said address loaded in said register.

5. A device for processing a video signal generated by a digital generating means, and, in response, for producing a modified video signal that allows an increased number of symbols per horizontal line on a display screen capable of displaying an image composed of a first field and a second field, whereby said first field is composed of a first plurality of raster lines created by patterns of active and inactive pixels, and said second field is composed of a second plurality of raster lines created by patterns of active and inactive pixels, comprising:

sync detection means, coupled to said digital generating means, operative for comparing said video signal against a sync level, and for generating a sync signal when said video signal is at a lower voltage than said sync level;

sync separation means, coupled to said sync detection means, operative for measuring the duration of said sync signal, and for generating a vertical sync signal when the duration of said sync signal is longer than a predetermined time;

pixel detection means, coupled to said digital generating means, operating for comparing said video signal against a luminance level, and in response, for generating a pixel signal representing either the condition when said video signal is above said luminance level or the condition when said video signal is below said luminance level;

field classifying means, coupled to said sync separation means, operative for modulo 2 counting of the number of pulses in said vertical sync signal, and for generating a field parity signal when said number of pulses is congruent to a predetermined value;

pixel classifying means, coupled to said pixel detection means, operative for modulo 2 counting of the number of single or contiguous groups of active pixels in said pixel signal, and in response, for generating a pixel parity signal when said number of single or contiguous groups of active pixels is congruent to a predetermined value;

gating means, coupled to said field classifying means and to said pixel classifying means, operative for comparing said field parity signal against said pixel parity signal, and in response for generating a blanking signal; and blanking means, coupled to said gating means and to said digital generating means, operative for generating said modified video signal, having a luminance level of approximately the blanking level voltage when said blanking signal is active and said video signal is at a higher voltage than said sync level, and operative for generating said modified video signal, having a luminance level of approximately the same voltage as said video signal when said blanking signal is inactive or when said video signal is at a lower voltage than said sync level.

6. The device of claim 5, wherein said field classifying means comprises first flip flop means clocked by said vertical sync signal.

7. The device of claim 6, wherein said pixel classifying means comprises second flip flop means clocked by said pixel signal.

8. The device of claim 7, wherein said second flip flop means in initialized by said vertical sync signal.

9. The device of claim 8, wherein said second flip flop means is initialized by said sync signal.

10. The device of claim 5, wherein said gating means comprises exclusive or means for generating a first voltage as said blanking signal when the level of said field parity signal is not equal to the level of said pixel parity signal, and for generating a second voltage as said blanking signal when said level of said field parity signal is equal to said level of said pixel parity signal.

11. The device of claim 10, wherein said blanking means further comprises:

monochrome means, operative for removing chrominance information from said modified video signal, and for producing a monochrome video signal; and injection means, operative for injecting the chrominance information required for a predetermined color into at least those portions of said monochrome video signal that correspond to an inactive blanking signal.

12. A process for displaying an increased number of symbols per horizontal line on a display screen capable of displaying an image composed of a first field and a second field, whereby said first field is composed of a first plurality of raster lines created by patterns of active and inactive pixels, and said second field is composed of a second plurality of raster lines created by patterns of active and inactive pixels, comprising the steps of:

providing a memory for storing representations of pixel patterns, addressed by a symbol number, a horizontal line number, and a field parity number;

obtaining a symbol number, and a representation using pixel patterns of a symbol corresponding to said symbol number;

selecting a horizontal line number, and the corresponding horizontal line of said representation of said symbol;

first programming said memory with every other single or plurality of contiguous active pixels from said horizontal line at an address corresponding to said symbol number, said horizontal line number, and a first field parity number;

second programming said memory with the remaining single or pluralities of contiguous active pixels from said horizontal line at an address corresponding to said symbol number, said horizontal line number, and a second field parity number;

repeating, for each horizontal line number that can address said memory, said steps of selecting a horizontal line number, first programming, and second programming;

repeating, for each symbol to be stored in said memory, said steps of obtaining a symbol number, selecting a horizontal line number, first programming, and second programming;

sequentially selecting in said first field a raster line, and a horizontal line number corresponding to which portion of a symbol said raster line intersects;

sequentially obtaining a symbol number whose corresponding symbol is to be displayed on said display screen;

displaying in said first field on said raster line those pixel patterns from said memory obtained at the address formed by said symbol number, said horizontal line number, and said first field parity number;

repeating, for each raster line in said first field, said steps of sequentially selecting in said first field, sequentially obtaining, and displaying in said first field;

sequentially selecting in said second field a raster line, and a horizontal line number corresponding to which portion of a symbol said raster line intersects;

sequentially obtaining a symbol number whose corresponding symbol is to be displayed on said display screen;

displaying in said second field on said raster line those pixel patterns from said memory obtained at the address formed by said symbol number, said horizontal line number, and said second field parity number; and repeating, for each raster line in said second field, said steps of sequentially selecting in said second field, sequentially obtaining, and displaying in said second field.

13. A device for processing a horizontal sync signal, a vertical sync signal, and a pixel signal, and, in response, for producing a modified video signal that allows an increased number of symbols per horizontal line on a display screen capable of displaying an image composed of a first field and a second field, whereby said first field is composed of a first plurality of raster line created by patterns of active and inactive pixels, and said second field is composed of a second plurality of raster lines created by patterns of active and inactive pixels, comprising:

field classifying means for receiving said vertical sync signal, and for modulo 2 counting of the number of pulses in said vertical sync signal, and in response, for generating a field parity signal when said number of pulses in said vertical sync signal is congruent to a predetermined value;

pixel classifying means for receiving said pixel signal, and for modulo 2 counting of the number of single or contiguous groups of active pixels represented by said pixel signal, and in response, for generating a pixel parity signal when said number of single or contiguous groups of active pixels is congruent to a predetermined value;

gating means, coupled to said field classifying means and to said pixel classifying means, operative for comparing said field parity signal against said pixel parity signal, and in response for generating a blanking signal; and blanking means, coupled to said gating means, operative for receiving said pixel signal, said blanking signal, said horizontal sync signal, and said vertical sync signal, and in response, for generating said modified video signal having a blanking level voltage when said horizontal sync signal is active or said vertical sync signal is active, for generating said modified video signal having a first luminance level voltage when said pixel signal is active and said blanking signal is inactive, and for generating said modified video signal having a second luminance level voltage when said pixel signal is inactive or said blanking signal is active.

14. The device of claim 13, wherein said field classifying means comprises first flip flop means clocked by said vertical sync signal, and wherein said pixel classifying means comprises second flip flop means clocked by said pixel signal.

15. The device of claim 14, wherein said second flip flop means is initialized by said vertical sync signal.

16. The device of claim 14, wherein said second flip flop means is initialized by said horizontal sync signal.

17. The device of claim 14, wherein said gating means comprises exclusive or means, having as input said pixel parity signal and said field parity signal, for generating a first voltage as said blanking signal when the level of said field parity signal is not equal to the level of said pixel parity signal, and for generating a second voltage as said blanking signal when said level of said field parity signal is equal to said level of said pixel parity signal.

18. The device of claim 14, wherein said blanking means further comprises:

monochrome means, operative for removing chrominance information from said modified video signal, and for producing a monochrome video signal; and injection means, operative for injecting the chrominance information required for a predetermined color into at least those portions of said monochrome video signal that correspond to an inactive blanking signal.

19. A process for transforming a video signal generated by a digital generating means, and for producing in response a modified video signal that allows an increased number of symbols per horizontal line on a display screen capable of displaying an image composed of a first field and a second field, whereby said first field is composed of a first plurality of raster lines created by patterns of active and inactive pixels, and said second field is composed of a second plurality of raster lines created by patterns of active and inactive pixels, comprising the steps of:

detecting sync information by comparing said video signal againt a sync level to form a sync signal when said video signal is at a lower voltage than said sync level;

separating vertical sync information to form a vertical sync signal when the duration of said sync signal is longer than a predetermined time;

detecting pixel information in said video signal to form a pixel signal;

counting modulo 2 the number of pulses in said vertical sync signal to form a field parity signal when said number of pulses in said vertical sync signal is congruent to a predetermined value;

counting modulo 2 the number of single or contiguous groups of active pixels in said pixel signal to form a pixel parity signal when said number of single or contiguous groups of active pixels is congruent to a predetermined value;

comparing said pixel parity signal against said field parity signal to form a blanking signal;

blanking said video signal, when said blanking signal is active and said video signal is at a higher voltage than said sync level, to form said modified video signal having a luminance level of approximately the blanking level voltage; and leaving said video signal substantially unchanged, when said blanking signal is inactive or video signal is at a lower voltage than said sync level, to form said modified video signal having a luminance level of approximately the same voltage as said video signal.

* * * * *